US007970156B2

(12) United States Patent
Fickweiler et al.

(10) Patent No.: US 7,970,156 B2
(45) Date of Patent: Jun. 28, 2011

(54) ADHESIVE FILM FOR THE PROTECTION OF HEARING DEVICE MICROPHONE PORTS AND CORRESPONDING HEARING DEVICE

(75) Inventors: Werner Fickweiler, Bubenreuth (DE); Uli Gommel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1233 days.

(21) Appl. No.: 11/636,956

(22) Filed: Dec. 11, 2006

(65) Prior Publication Data

US 2007/0140516 A1 Jun. 21, 2007

(30) Foreign Application Priority Data

Dec. 20, 2005 (EP) ..... 05027948

(51) Int. Cl.
*H04R 25/00* (2006.01)

(52) U.S. Cl. ..... 381/325; 381/322; 381/324; 381/330

(58) Field of Classification Search ..... 381/325, 381/322, 328, 324; 379/439, 452
See application file for complete search history.

(56) References Cited

U.S. PATENT DOCUMENTS

| | | | | |
|---|---|---|---|---|
| 3,976,848 | A * | 8/1976 | Estes | 381/322 |
| 5,401,920 | A | 3/1995 | Oliveira | |
| 6,144,750 | A * | 11/2000 | Levin | 381/328 |
| 6,164,409 | A | 12/2000 | Berger | |
| 7,676,050 | B2 * | 3/2010 | Sauer | 381/324 |
| 2004/0196996 | A1 * | 10/2004 | Feitel | 381/322 |

FOREIGN PATENT DOCUMENTS

EP 0 310 866 A1 4/1989

* cited by examiner

*Primary Examiner* — Curtis Kuntz
*Assistant Examiner* — Jasmine Pritchard

(57) ABSTRACT

The protection of the ports of a hearing device, in particular microphone ports, is to be more easily operable in terms of installation and replacement. Provision is made for this purpose for protection to be provided by an adhesive film with a plastic membrane, which is essentially acoustically permeable, and an adhesive layer, which is attached to the plastic membrane. The adhesive is cut out in a predetermined shape at least one specified location on the plastic membrane. It is thus possible to affix an easily operable common microphone protection system to the hearing device shell, for example for a directional microphone with several microphone ports.

9 Claims, 2 Drawing Sheets

ADHESIVE FILM FOR THE PROTECTION OF HEARING DEVICE MICROPHONE PORTS AND CORRESPONDING HEARING DEVICE

CROSS REFERENCE TO RELATED APPLICATIONS

This application claims priority of European application No. 05027948.8 filed Dec. 20, 2005, which is incorporated by reference herein in its entirety.

FIELD OF THE INVENTION

The present invention relates to an adhesive film for the protection of a microphone port of a hearing device with a plastic membrane, which is essentially acoustically permeable, and an adhesive layer, which is attached to the plastic membrane.

BACKGROUND OF THE INVENTION

Hearing devices are continuously exposed to the risk of contamination when being worn. The microphone inputs are particularly sensitive, as they are designed to be as acoustically transparent as possible, but also to keep dirt away from the acoustic converters.

The protection of hearing device microphones from moisture, suspended matter (e.g. grease, dust particles, cerumen, water spray and suchlike) using special protection systems is known in order to extend the lifetime of the microphones. As the microphone protection systems generally draw dirt into or onto themselves, it is also desirable for the protection system to be easily removable from the outside after it is worn out.

An apparatus of this type for sealing hearing device ports or ear molds is known for example from the publication EP 0 310 866 A1. Such ports allow the entry and exit of sound, or ventilation for example. A microporous membrane made of non-adhesive material may be inserted into the respective port. The membrane is placed in the interior of a casing or injected into a port of the casing for example. The casing is then attached to the relevant port of the hearing device. If a hearing device has a directional microphone with several microphone ports, then said ports must be protected individually. The application or replacement of the microphone protection system is relatively laborious.

A cerumen filter for hearing devices is known from the publication U.S. Pat. No. 5,401,920 A. It consists of a film which is adhered to the hearing device. The film comprises an acoustically permeable membrane and a film disposed therebelow which exhibits a hole where the sound passage is located.

Patent specification U.S. Pat. No. 6,164,409 A further discloses a protective membrane for hearing devices, which covers a sound outlet. The membrane is fixed to an assembly ring.

SUMMARY OF THE INVENTION

The object of the present invention therefore consists in presenting a hearing device with a microphone protection system for several microphones, which can be easily attached to the hearing device and is easy to replace.

This object is achieved in accordance with the invention by a hearing device as claimed in the claims.

Advantageously, it is thus possible to attach the microphone protection in the form of an adhesive film to the microphone port with little effort. In particular, it is possible to mask several microphone ports with one single adhesive film.

The adhesive cut-out positioned directly above the microphone port prevents sound from being damped by the adhesive as it passes through.

The predetermined shape of each of the two or more cut-outs of the adhesive can consist of a point. This point should exhibit the same external shape as the microphone port. This point will most commonly be circular, but it may also assume a rectangular, square, triangular, oval or other shape.

A further advantageous development of the adhesive film is that it is essentially oblong in shape, with the two or more points of the cut-out adhesive being arranged in a row in parallel to the main direction of extension of the adhesive film. This geometric arrangement is particularly favorable for protecting directional microphone ports.

The housing of hearing device may exhibit a common indentation in the region of the ports, into which indentation the adhesive film is adhered, with the adhesive film essentially exhibiting the same external shape as the indentation. It is thus easily possible to affix the adhesive film to the housing in a precise manner. By way of example, the adhesive film can also be easily affixed in the manner of a microphone protection system for a directional microphone.

The indentation for the adhesive film can be formed by a separate shell introduced into the housing shell or by an edging cast onto the housing shell. The indentation can thus be realized in a simple manner.

BRIEF DESCRIPTION OF THE DRAWINGS

The present invention is now described in more detail below with reference to the appended drawings, in which.

DETAILED DESCRIPTION OF THE INVENTION

The exemplary embodiment illustrated below represents a preferred embodiment of the present invention.

Figure 1:
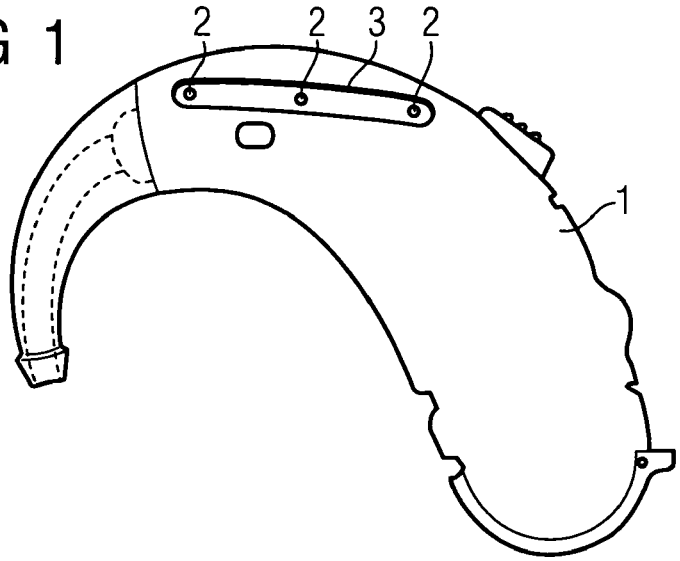
FIG. 1 shows a lateral view of a behind-the-ear hearing device without a microphone protection cover.

The behind-the-ear hearing device illustrated in the lateral view in FIG. 1 exhibits a hearing device shell 1, in which microphone ports 2 of a directional microphone can be identified. The directional microphone ports 2 are arranged in a row so that a corresponding directional effect can be achieved.

The three microphone ports 2 are arranged in a row in an oblong indentation 3.

Figure 2:
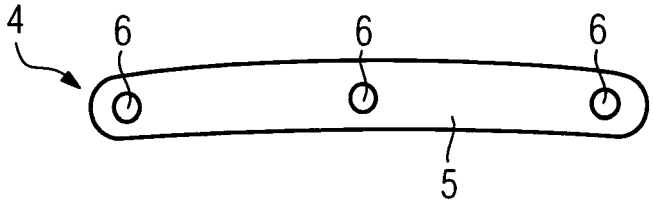
FIG. 2 shows a top view of an inventive adhesive film from the side of the adhesive.

In FIG. 2 an adhesive film 4 is shown as viewed from the side of the adhesive, essentially exhibiting the same contours as the indentation 3 in the hearing device shell 1. The film 4 can thus be positioned on the indentation 3 in a precise manner.

The adhesive film comprises a plastic membrane 10 which performs the protective function and which is simultaneously used as the medium for the adhesive 5. In order to prevent acoustic damping from occurring in front of the ports due to the adhesive 5 or due to particles adhering to the adhesive, cut-outs 6 are provided at points on the adhesive film 4 which correspond to the ports 2, with which cut-outs no adhesive 5 is applied to the membrane.

Figure 3:
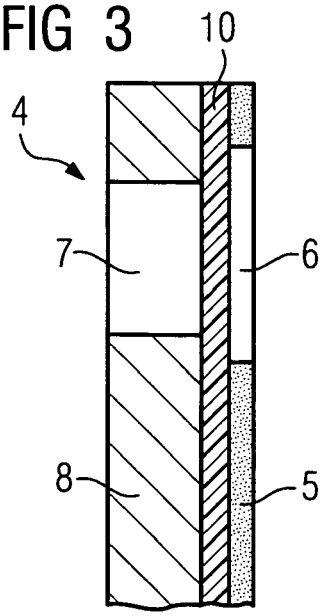
FIG. 3 shows a partial cross-section of an inventive protection apparatus.

On the adhesive-free side the adhesive film 4 can be reinforced for reasons of stability with a plastic strip, which in turn exhibits corresponding boreholes 7 in the region of the microphone ports 2. A partial cross-section of such a protection system is shown in FIG. 3. The plastic medium 8 thus exhibits a borehole 7 over which the membrane 10 is then laminated. The adhesive 5 is then applied to the side of the plastic membrane 10 facing away from the plastic medium 8, with the adhesive cut-out 6 being arranged around the borehole 7.

Figure 4:
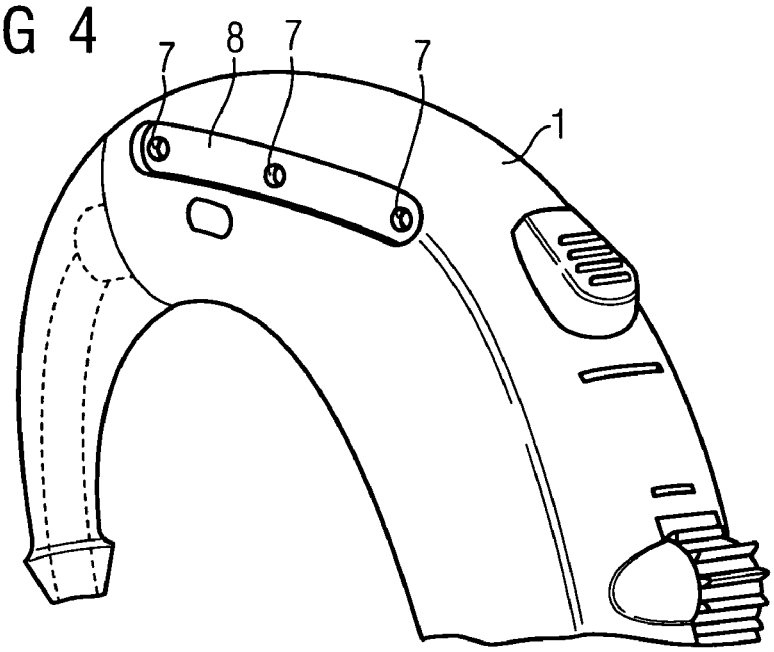
FIG. 4 shows a perspective view of a hearing device segment with an affixed microphone protection adhesive film.

With the hearing device shown in FIG. 4, the protection apparatus with the plastic medium 8 and the three boreholes 7 presented in FIG. 3 is inserted into the indentation 3 so that the plastic medium 8 is essentially flush with the surface of the hearing device shell 1.

A microporous membrane can be used as the plastic membrane 10. One such ePTFE membrane is manufactured by the company Gore. These films repel grease, dirt and water. Teflon films and fabric films can also be used in accordance with the invention. Their acoustic damping should be less than 2 dB, so that they can essentially be designated as sound-permeable.

Figure 5:
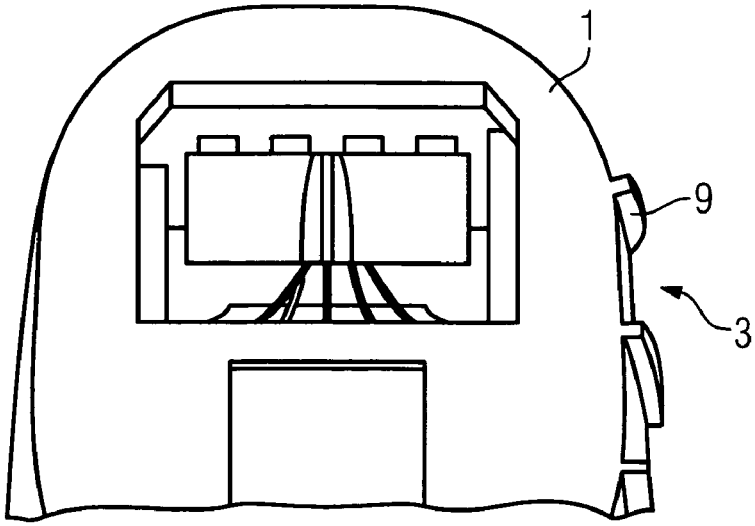
FIG. 5 shows a cross-section through an inventive hearing device.

In the exemplary embodiment of FIG. 5 the indentation into which the microphone protection system is adhered is realized by its own shell 9 which is introduced into the housing shell 1. The edging of the shell 9 is advantageous in that the microphone protection system can be positioned easily. If this edging of the shell 9 is interrupted at a point, the protective film can be lifted off more easily using a fingernail for example.

The adhesive 5 preferably wholly surrounds the cut-outs 6, so that no dirt can enter the microphone ports 2 between the film 4 and the housing shell 1.

The size of the inventive microphone protection system is such that it is easy to operate. In particular, operation is made easier if the microphone protection system offers uniform protection for all microphones and is thus appropriately sized. Uniform microphone port protection has the additional advantage that the directional character does not change in the event of contamination, because all microphones are generally contaminated in a similar manner.

A further advantage of the inventive microphone protection system is that the adhesion counteracts a capillary effect, because there is no gap between the hearing device shell 1 and the microphone protection system. This prevents sweat from entering the device. A further advantage, namely that the indentation 3 in the housing shell 1 facilitates the installation and replacement of the microphone protection system, has already been mentioned. The microphone protection system described in the exemplary embodiment thus offers numerous advantages overall.

Where applicable, the embodiments of a microphone protection system described above may also be modified slightly for use with other ports of a hearing device e.g. for a vent or sound exit port.

What is claimed is:

1. A hearing device, comprising:

a plurality of microphone ports; and a common adhesive film that covers the microphone ports, the common adhesive film comprising:

an essentially acoustically permeable plastic membrane, an adhesive layer attached to a side of the plastic membrane, a plurality of cut out points in the plastic membrane at locations of the microphone ports, a plastic medium laminated on another side of the plastic membrane facing away from the adhesive layer, and a plurality of boreholes in the plastic medium at the locations of the microphone ports.

2. The hearing device as claimed in claim 1, wherein the common adhesive film is essentially oblong and the cut out points are arranged in a row parallel to a direction of extension of the common adhesive film.

3. The hearing device as claimed in claim 1, wherein the cut out points are adhesive free.

4. The hearing device as claimed in claim 1, wherein a shape of each of the cut out points is essentially identical to an external shape of each of the microphone ports respectively.

5. The hearing device as claimed in claim 1, wherein a housing shell of the hearing device comprises a common indentation in a region of the microphone ports.

6. The hearing device as claimed in claim 5, wherein the common adhesive film is adhered to the common indentation.

7. The hearing device as claimed in claim 6, wherein a shape of the common adhesive film is essentially identical to a shape of the common indentation.

8. The hearing device as claimed in claim 5, wherein the common indentation comprises a separate shell introduced into the housing shell.

9. The hearing device as claimed in claim 5, wherein the common indentation comprises an edging cast onto the housing shell.

* * * * *